US010082133B2

(12) United States Patent
Goebel

(10) Patent No.: US 10,082,133 B2
(45) Date of Patent: Sep. 25, 2018

(54) HALL THRUSTER WITH MAGNETIC DISCHARGE CHAMBER AND CONDUCTIVE COATING

(71) Applicant: CALIFORNIA INSTITUTE OF TECHNOLOGY, Pasadena, CA (US)

(72) Inventor: Dan Michael Goebel, Tarzana, CA (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 0 days.

(21) Appl. No.: 15/064,535

(22) Filed: Mar. 8, 2016

(65) Prior Publication Data

US 2016/0265517 A1 Sep. 15, 2016

Related U.S. Application Data

(60) Provisional application No. 62/131,418, filed on Mar. 11, 2015.

(51) Int. Cl.
*F03H 1/00* (2006.01)

(52) U.S. Cl.
CPC ..... *F03H 1/0006* (2013.01); *F03H 1/0075* (2013.01)

(58) Field of Classification Search
CPC ..... B64G 1/405; F03H 1/0037; F03H 1/0062; F03H 1/0068; F03H 1/0075
See application file for complete search history.

(56) References Cited

U.S. PATENT DOCUMENTS

| | | | | |
|---|---|---|---|---|
| 5,646,476 | A * | 7/1997 | Aston | F03H 1/0075 313/154 |
| 6,208,080 | B1 | 3/2001 | King et al. | |
| 7,220,488 | B2 * | 5/2007 | Wadle | H05K 9/0075 428/432 |
| 7,500,350 | B1 | 3/2009 | Jacobson et al. | |
| 9,089,040 | B2 | 7/2015 | Ozaki et al. | |
| 9,127,654 | B2 | 9/2015 | Barral et al. | |
| 9,334,855 | B1 * | 5/2016 | Hruby | F03H 1/00 |
| 9,453,502 | B2 | 9/2016 | Goebel et al. | |
| 9,874,202 | B2 | 1/2018 | Goebel et al. | |

(Continued)

FOREIGN PATENT DOCUMENTS

WO 2010133802 A1 11/2010

OTHER PUBLICATIONS

Hofer, Magnetic shielding of a laboratory Hall thruster II Experiments, Jan. 2014, Journal of Applied Physics 115, pp. 1 and 3.*

(Continued)

*Primary Examiner* — Gerald L Sung
*Assistant Examiner* — William Breazeal
(74) *Attorney, Agent, or Firm* — Steinfl + Bruno, LLP

(57) ABSTRACT

Hall thrusters with conductive coatings are disclosed. A Hall thruster comprises magnetic shielding in order to avoid collisions with the inner walls of its discharge chamber. By removing the source of erosion, the walls of the chamber can be removed reducing mass, cost and complexity of the thruster. A conductive coating, such as an aluminum coating, is deposited on inner screens between the discharge chamber and the magnetic poles of the thruster. The magnetic field within the chamber shields the conductive coating deposited on the inner and outer screens of the chamber.

5 Claims, 5 Drawing Sheets

(56) References Cited

U.S. PATENT DOCUMENTS

| | | | | |
|---|---|---|---|---|
| 2002/0116915 | A1 | 8/2002 | Hruby et al. | |
| 2005/0086926 | A1 | 4/2005 | King | |
| 2005/0162249 | A1* | 7/2005 | Simola | H05K 9/0003 335/301 |
| 2009/0229240 | A1 | 9/2009 | Goodfellow | |
| 2010/0107596 | A1 | 5/2010 | Kapulkin et al. | |
| 2010/0188000 | A1* | 7/2010 | Duchemin | F03H 1/0075 315/111.81 |
| 2012/0117938 | A1* | 5/2012 | Barral | F03H 1/0075 60/202 |
| 2013/0026917 | A1* | 1/2013 | Walker | F03H 1/0075 315/85 |
| 2016/0333866 | A1 | 11/2016 | Goebel et al. | |

OTHER PUBLICATIONS

Goebel "Conducting Wall Hall Thrusters" (2013).*
Fife, J.M., "Hybrid-PIC Modeling and Electrostatic Probe Survey of Hall Thrusters," Ph.D. thesis, Massachusetts Institute of Technology, 256 pages (nonconsecutive), (1998).
Hofer, R.R. et al., "High-Specific Impulse Hall Thrusters, Part 1: Influence of Current Density and Magnetic Field," J. Propul. Power, vol. 22, No. 4, pp. 721-731, (2006).
Manzella, D. et al., "Laboratory Model 50kW Hall Thruster," AIAA Paper No. 02-3676, 12 pages, (2002).
Mikellides, I.G. et al., "Hall-Effect Thruster Simulations with 2-D Electron Transport and Hydrodynamic Ions," IEPC Paper No. 09-114, 23 pages, (2009).
Mikellides, I.G. et al., "Magnetic Shielding of the Channel Walls in a Hall Plasma Accelerator," Phys. Plasmas, 18, 3, 033501 1-18, 19 pages, (2011).
Peterson, P. et al., "The Performance and Wear Characterization of a High-Power High-Isp NASA Hall Thruster," AIAA Paper No. 05-4243, 16 pages, (2005).
Rubin, B. et al., "Total and Differential Sputter Yields of Boron Nitride Measured by Quartz Crystal Microbalance," J. Phys. D: Appl. Phys., 42, 205205, 11 pages, (2009).
Shastry, R., "Experimental Characterization of the Near-Wall Region in Hall Thrusters and Its Implications on Performance and Lifetime," Ph.D. Dissertation, Aerospace Engineering, University of Michigan, 230 pages, (2011).
Welander, B. et al., "Life and Operating Range Extension of the BPT-4000 Qualification Model Hall Thruster," AIAA Paper No. 06-5263, 6 pages, (2006).
Yamamura, Y. et al., "Energy Dependence of Ion-Induced Sputtering Yields from Monatomic Solids at Normal Incidence," Atomic Data and Nuclear Data Tables, 62, pp. 149-253, (1996).
Katz, I., et al., "Channel Wall Plasma Thermal Loads in Hall Effect Thrusters with Magnetic Shielding," 47th AIAA/ASME/SAE/ASEE Joint Propulsion Conference & Exhibit, AIAA, Reston, VA, 9 pages, (2011).
Shastry, R., et al., "Experimental Characterization of the Near-Wall Plasma in a 6-kW Hall Thruster and Comparison to Simulation," 47th AIAA/ASME/SAE/ASEE Joint Propulsion Conference & Exhibit, AIAA, Reston, VA, 22 pages, (2011).
Ahedo, E. "Presheath/sheath model with secondary electron emission from two parallel walls" Physics of Plasmas, vol. 9, No. 10, pp. 4340-4347, Oct. 2002.
Ahedo, E. et al. "Fulfillment of the kinetic Bohm criterion in a quasineutral particle-in-cell model" Physics of Plasmas, vol. 17, 073507, 14 pages, 2010.
Ahedo, E. et al. "Partial trapping of secondary-electron emission in a Hall thruster plasma" Physics of Plasmas, vol. 12, 073503, 9 pages, 2005.
Bareilles, J. et al. "Critical assessment of a two-dimensional hybrid Hall thruster model: Comparisons with experiments" Physics of Plasmas, vol. 11, No. 6, pp. 3035-3046, Jun. 2004.
Barral, S. et al. "Wall material effects in stationary plasma thrusters. II. Near-wall and in-wall conductivity" Physics of Plasmas, vol. 10, No. 10, pp. 4137-4152, Oct. 2003.
Bohm, D. et al., "Chapter 3: Minimum Ionic Kinetic Energy for a Stable Sheath" Characteristics of Electrical Discharges in Magnetic Fields McGraw-Hill, New York, p. 77-86, 1949.
Boniface, C. et al. "Anomalous cross field electron transport in a Hall effect thruster" Applied Physics Letters, vol. 89, 161503, 5 pages, 2006.
Braginskii, S. I., "Transport Processes in a Plasma," Reviews of Plasma Physics, vol. 1, Consultants Bureau, New York, pp. 205-311. 1965.
CoorsTek and Ceramic Industries, "Materials properties charts", 2013, https://web.archive.org/web/20130701201335/http://www.ceramicindustry.com/ext/resources/pdfs/2013-CCD-Material-Charts.pdf. 18 pgs.
Courtney, D. et al. "Continued Investigation of Diverging Cusped Field Thruster" 44th AIAA/ASME/SAE/ASEE Joint Propulsion Conference & Exhibit, 13 pages, Jul. 21-23, 2008.
Dimits, A. M., "Fluid Simulations of Tokamak Turbulence in Quasiballooning Coordinates," Physical Review E, vol. 48, No. 5, pp. 4070-4079, Nov. 1993.
Ducrocq, A. et al. "High-frequency electron drift instability in the cross-field configuration of Hall thrusters" Physics of Plasmas, vol. 13, 102111, 10 pages, 2006.
Fife, J. M., et al. "A Numerical Study of Low-Frequency Discharge Oscillations in Hall Thrusters," American Institute of Aeronautics and Astronautics, Proceeding of the 33rd Joint Propulsion Conference, Seattle, 1997. 12 pages.
Gamero-Castaño, M. and Katz, I., "Estimation of Hall Thruster Erosion Using HPHall," 29th International Electric Propulsion Conference, Princeton, NJ, 11 pages, Oct. 31-Nov. 4, 2005.
Grys, K. et al., "4.5 kW Hall Thruster System Qualification Status" 41st AIAA Paper No. 05-3682, 11 pages, Jul. 10-13, 2005.
Grys, K. et al., "Demonstration of 10,400 Hours of Operation on a 4.5 kW Qualification Model Hall Thruster" 46th AIAA Paper No. 10-6698, 11 pages, Jul. 25-28, 2010.
Hagelaar, G. et al. "Two-dimensional model of a stationary plasma thruster" Journal of Applied Physics, vol. 91, No. 9, pp. 5592-5598, May 1, 2002.
Hargus et al. "Hall Effect Thruster Ground Testing Challenges" 25th Aerospace Testing Seminar, Air Force Research Laboratory. Aug. 18, 2009. 23 pages.
Hobbs, G. D. et al. "Heat Flow Through a Langmuir Sheath in the Presence of Electron Emission," Plasma Physics, vol. 9, pp. 85-87, 1967.
Hofer, R, et al. "Evaluation of a 4.5 kW Commercial Hall Thruster System for NASA Science Missions" 42nd AIAA Paper No. 6-4469, 27 pages, Jul. 9-12, 2006.
Hofer, R. et al. "BPT-4000 Hall Thruster Discharge Chamber Erosion Model Comparison with Qualification Life Test Data" IEPC-2007-267, 30th International Electric Propulsion Conference, Florence, Italy, 24 pages, Sep. 17-20, 2007.
Hofer, R. et al. "BPT-4000 Hall Thruster Extended Power Throttling Range Characterization for NASA Science Missions" IEPC-2009-085, 31st International Electric Propulsion Conference, Ann Arbor, MI, 22 pages. Sep. 20-24, 2009.
Hofer, R., et al., "Efficacy of Electron Mobility Models in Hybrid-PIC Hall Thruster Simulations," 44th AIAA Joint Propulsion Conference, AIAA Paper 2008-4924, Hartford, CT, 30 pages, Jul. 21-23, 2008.
Hofer, R., et al., "Wall Sheath and Electron Mobility Modeling in Hybrid-PIC Hall Thruster Simulations," 43rd AIAA Joint Propulsion Conference, AIAA Paper 2007-5267, Cincinnati, OH. pp. 2632-2646, 2007.
HTW "Germany Glassy Carbon" 2006 https://web.archive.org/web/20061101215745/http://www.htw-germany.com/technology.php5?lang=en&nav0=2 . 3 pgs.
Huang, W., et al., "Laser-Induced Fluorescence of Singly-Charged Xenon Inside a 6-kW Hall Thruster," 45th AIAA Joint Propulsion Conference, AIAA Paper 2009-5355, Denver, CO, 5223-5245, Aug. 2-5, 2009. 24 pages.

(56) References Cited

OTHER PUBLICATIONS

Kamhawi, H. et al., "In-Space Propulsion High Voltage Hall Accelerator Development Project Overview" 45th AIAA Paper No. 9-5282, Denver, CO, 13 pages, Aug. 2-5, 2009.
Kamhawi, H. et al., JANNAF, Proceedings of the Sixth MSS, Fourth LPS, Third SPS Joint JANNAF Meeting, Orlando, FL Chemical Propulsion Information Analysis Center, Columbia, MD, vol. 34, No. 6, 2008, Paper No. SPS-III-11. 21 pgs.
Katz, I. et al. "Ion Current in Hall Thrusters" IEEE Transactions on Plasma Science, vol. 36, No. 5, pp. 2015-2024, Oct. 2008.
Katz, I. et al. "Neutral gas free molecular flow algorithm including ionization and walls for use in plasma simulations" Journal of Computational Physics, vol. 230, pp. 1454-1464, 2011.
Katz, I., and Mikellides, I. G., "A New Algorithm for the Neutral Gas in the Free-Molecule Regimes of Hall and Ion Thrusters," 31st International Electric Propulsion Conference, IEPC Paper 2009-95, Ann Arbor, MI, 10 pages, Sept 20-24, 2009.
Kornfeld, G. et al. "Physics and Evolution of HEMP-Thrusters" 30th IEPC, Florence Italy, 19 pages, Sep. 17-20, 2007.
Lazurenko, A. et al. "Determination of the electron anomalous mobility through measurements of turbulent magnetic field in Hall thrusters" Physics of Plasmas, vol. 14, 033504, 13 pages, 2007.
LeBrun, M. J., et al., "Toroidal Effects on Drift Wave Turbulence," Physics of Fluids B, vol. 5, No. 3, pp. 752-773, Mar. 1993.
Lin, Z., et al., "Turbulent Transport Reduction by Zonal Flows: Massively Parallel Simulations," Science, vol. 281, pp. 1835-1837, 1998.
Marchand, R. et al. "CARRE: a quasi-orthogonal mesh generator for 2D edge plasma modelling" Computer Physics Communications, vol. 96, pp. 232-246, 1996.
Marchand, R., et al., "Unstructured Meshes and Finite Elements in Space Plasma Modelling: Principles and Applications," in Advanced Methods for Space Simulations, Tokyo, pp. 111-143, 2007.
McDonald, M. et al. "Cathode position and orientation effects on cathode coupling in a 6-kW Hall Thruster" 31st IEPC, Ann Arbor, MI, 11 pages, Sep. 20-24, 2009.
Mikellides, I. et al. "Magnetic Shielding of the Acceleration Channel Walls in a Long-Life Hall Thruster" 46th AIAA/ASME/SAE/ASEE Joint Propulsion Conference & Exhibit, 26 pages, Jul. 25-28, 2010.
Mikellides, I. et al. "Wear Mechanisms in Electron Sources for Ion Propulsion, I: Neutralizer Hollow Cathode," Journal of Propulsion and Power, vol. 24, No. 4, pp. 855-865, 2008.
Mikellides, I. et al. "Wear Mechanisms in Electron Sources for Ion Propulsion, II: Discharge Hollow Cathode," Journal of Propulsion and Power, vol. 24, No. 4, pp. 866-879, 2008.
Mikellides, I. et al. "Hollow cathode theory and experiment. II. A two-dimensional theoretical model of the emitter region" Journal of Applied Physics, vol. 98, 113303, 15 pages, 2005.
Mikellides, I. et al. "Numerical Simulations of a Hall Thruster Hollow Cathode Plasma" IEPC-2007-018, 30th IEPC, Florence Italy, 13 pages, Sep. 17-20, 2007.
Morozov A. I., and Savelyev, V. V., "Fundamentals of Stationary Plasma Thruster Theory," Reviews of Plasma Physics, 21, p. 203-391, 2000.
Muller, A. "Experimental Cross Sections for Electron-impact Ionization and Electron-ion Recombination", Research Coordination Meeting, IAEA CRP, Vienna, 2 pages, Mar. 4-6, 2009.
Non-Final Office Action issued for U.S. Appl. No. 13/768,788, filed Feb. 15, 2013 on behalf of California Institute of Technology. dated Aug. 11, 2015. 19 pages.
Non-Final Office Action issued for U.S. Appl. No. 15/218,682, filed Jul. 25, 2016 on behalf of California Institute of Technology. dated Jul. 10, 2017. 17 pages.
Notice of Allowance issued for U.S. Appl. No. 13/768,788, filed Feb. 15, 2013 on behalf of California Institute of Technology. dated Jun. 3, 2016. 11 pages.
Notice of Allowance issued for U.S. Appl. No. 13/768,788, filed Feb. 15, 2013 on behalf of California Institute of Technology. dated Jul. 15, 2016. 9 pages.
Oh, D.Y. "Evaluation of Solar Electric Propulsion Technologies for Discovery-Class Missions" J. Spacecraft and Rockets vol. 44, No. 2, 2007. pp. 399-411.
Omega.com "Table of Emissivity Values, 2004" https://web.archive.org/web/20040125054311/http://ib.cnea.gov.ar/~experim2/Cosas/omega/emisivity.htm. 6 pg.
Parra, F. I., et al., "A Two-Dimensional Hybrid Model of the Hall Thruster Discharge," Journal of Applied Physics, vol. 100, 13 pages, Published online Jul. 26, 2006.
Pencil, E. et al. "End-of-Life Stationary Plasma Thruster Far-Field Plume Characterization" American Institute of Aeronautics and Astronautics, Inc. 29 pages, 1996.
Raitses, Y. et al. "Electron-wall interaction in Hall thrusters" Physics of Plasmas, vol. 12, 057104, 11 pages, 2005.
Reid, B. M., "The Influence of Neutral Flow Rate in the Operation of Hall Thrusters," Ph.D. Thesis, Aerospace Engineering, University of Michigan, 384 pages, 2009.
Riemann, K. "The Bohm Criterion and Boundary Conditions for a Multicomponent System" IEEE Transactions on Plasma Science, vol. 23, No. 4, pp. 709-716, Aug. 1995.
Riemann, K. "The Bohm criterion and sheath formation" J. Phys. D.: Appl. Phys. vol. 24, pp. 493-518, 1991.
Taccogna, F. et al. "Plasma sheaths in Hall discharge" Physics of Plasmas, vol. 12, 093506, 16 pages, 2005.

* cited by examiner

HALL THRUSTER WITH MAGNETIC DISCHARGE CHAMBER AND CONDUCTIVE COATING

CROSS REFERENCE TO RELATED APPLICATIONS

The present application claims priority to U.S. Provisional Patent Application No. 62/131,418, filed on Mar. 11, 2015, and may be related to U.S. patent application Ser. No. 13/768,788, filed on Feb. 15, 2013, the disclosures of both of which are incorporated herein by reference in their entirety.

STATEMENT OF INTEREST

The invention described herein was made in the performance of work under a NASA contract NNN12AA01C, and is subject to the provisions of Public Law 96-517 (35 USC 202) in which the Contractor has elected to retain title.

TECHNICAL FIELD

The present disclosure relates to space vehicle engines. More particularly, it relates to a Hall thruster with magnetic discharge chamber and conductive coating.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

SUMMARY

Figure 1:
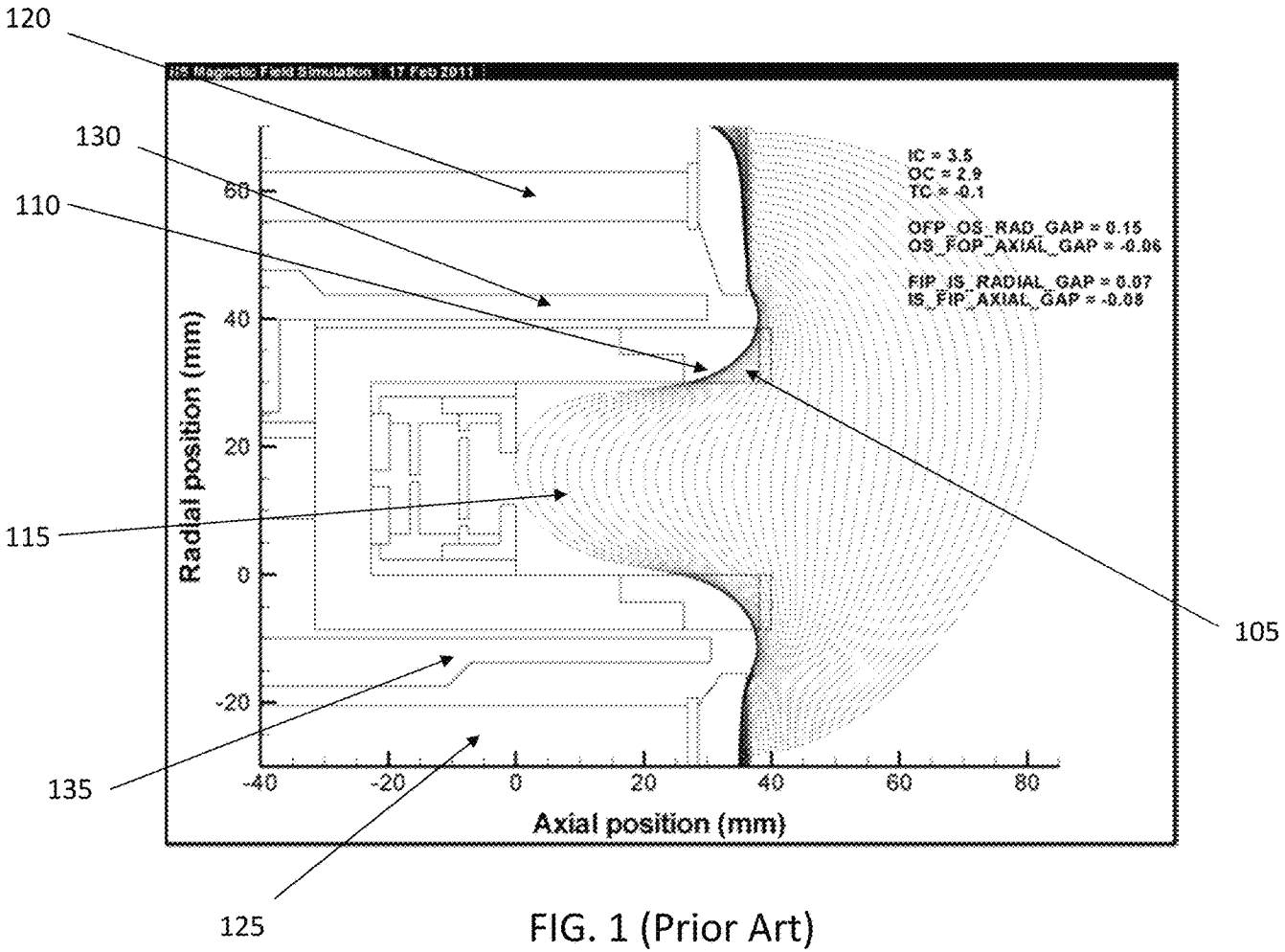
FIG. 1 (Prior Art)
FIG. 1 illustrates the magnetic field lines in a conventional Hall thruster.

In a first aspect of the disclosure, a Hall thruster is described, comprising: an annular discharge chamber having a rear flat surface, a front flat aperture, an inner annular surface and an outer annular surface; a gas distributor adjacent to the rear surface of the annular discharge chamber; an anode adjacent to the rear surface of the annular discharge chamber; a cathode adjacent to the front aperture of the annular discharge chamber, the anode and cathode configured to generate an electric field within the annular discharge chamber; an inner annular screen adjacent to the inner annular surface; an outer annular screen adjacent to the outer annular surface; a conductive coating deposited on the inner and outer annular screens; magnetic poles configured to generate magnetic field in the annular discharge chamber, the magnetic field configured to substantially avoid collisions of charged particles against the conductive coating.

DETAILED DESCRIPTION

Hall thrusters generate thrust through the formation of an azimuthal electron current that interacts with an applied, quasi-radial magnetic field to produce an electromagnetic force on the plasma. These thrusters provide an attractive combination of thrust and specific impulse for a variety of near-earth missions and, in many cases, they allow for significant reductions in propellant mass and overall system cost compared to conventional chemical propulsion. The range of thrust and specific impulse attainable by Hall thrusters makes them applicable also to a variety of NASA science missions.

The present disclosure describes an improvement to Hall thruster designs, for example, Hall thrusters with a magnetic discharge chamber that use a magnetic field configuration observed to reduce the erosion rate of the walls, as described in U.S. patent application Ser. No. 13/768,788. The present disclosure also describes a magnetic discharge chamber, however with a different configuration. Specifically, the present disclosure describes the use of a different material such as graphite for the ceramic walls instead of the more expensive boron nitride (BN) or $BNSiO_2$ materials that are currently used.

The problem to be solved with the present disclosure relates to the presence of ceramic walls in the discharge chamber. These walls increase cost and complexity for the thruster although their purpose of confining the plasma discharge has been largely eliminated. In fact, with the proper application of a magnetic field, the erosion of the walls is greatly decreased. Therefore, the need for protective ceramic materials deposited on the walls of the chamber is greatly decreased.

The ceramic walls present in previous designs can represent a significant excess mass in a large Hall thruster, and take up valuable space in a miniature Hall thruster. In fact, in miniature Hall thrusters the volume available for the plasma discharge and the shaped magnetic fields is small, and this volume is very critical to enable the operation of the thruster.

The present disclosure eliminates the protective walls of the discharge chamber entirely. The confining boundaries for the plasma and the propellant gas flow through the channel are defined by the magnetic circuit, therefore it is not possible to have walls made of magnetic materials. In other words, the discharge chamber has magnetic walls that are part of the magnetic circuit which enables confinement of the plasma without significant erosion of the chamber walls. This eliminates the need to use expensive ceramic materials that increase cost and mass of the thruster.

In the magnetically shielded thrusters described herein, the discharge channel wall constitutes the surface of the magnetic screen. This surface is now plasma facing, and so can be sprayed with alumina or clad with a thin layer of another material to provide better thermal properties Eliminating a separate discharge chamber wall reduces the thruster mass and complexity, which reduces its cost. The properties of the plasma facing surface can be selected by coating this surface with a thin layer of insulating alumina or cladding the surface with copper or refractory metals to improve the thermal properties such as reflectivity and conductivity. This thin layer is not significantly eroded because of the magnetic shielding applied in the chamber.

Additionally, eliminating the protective discharge chamber walls frees up valuable volume in small thrusters for the plasma and the magnetic circuit. A magnetic shielding configuration modifies the shape of the magnetic field in the thruster near the wall to significantly reduce the plasma contact, which enables the discharge chamber walls to be changed to cheaper and easier to fabricate materials like graphite. The present disclosure, additionally, describes a different design for the discharge chamber, eliminating the discharge chamber electrode as a separate element. In other words, the walls of the magnetic circuit act as the discharge chamber, including acting as electrodes, without the need of having a separate electrode. This design eliminates one of the more difficult structures in the Hall thruster, reducing mass and cost. The improved design of the present disclosure will be made apparent in the following figures.

FIG. 1 illustrates the magnetic field lines in a conventional Hall thruster. The magnetic field lines (105) in the channel (115) are intersecting the wall (110). Plasma follows the field lines to bombard the boron nitride wall. This leads to wall erosion and the need to have a protective ceramic coating. The thruster of FIG. 1 illustrates a north pole (120) and a south pole (125) for the magnetic circuit. The chamber walls, such as (110), are coated with boron nitride. Outer (130) and inner (135) screens or shunts are also illustrated.

Figure 2:
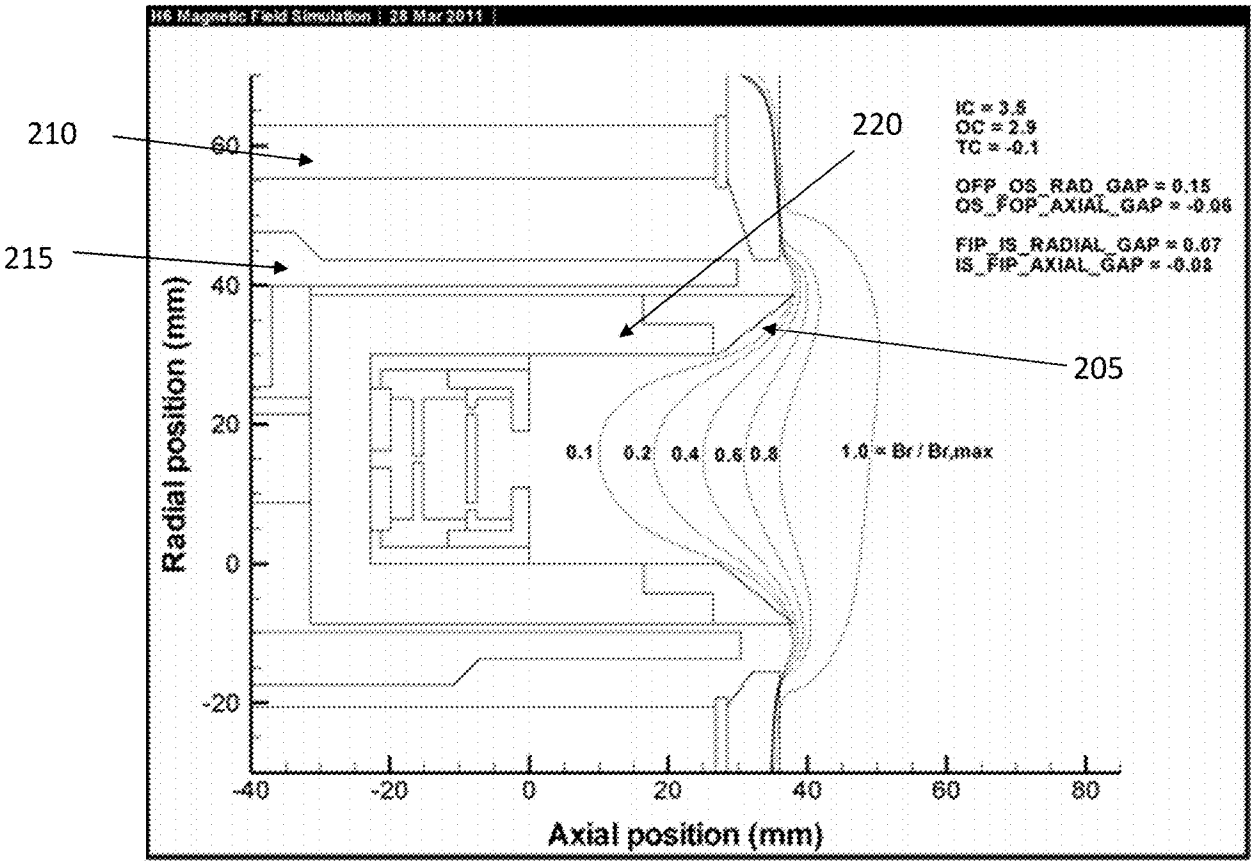
FIG. 2 (Prior Art)
FIG. 2 illustrates a magnetically-shielded configuration with lines curving over the surface of the boron nitride walls.

FIG. 2 illustrates a thruster with walls (220), poles (210) and screens (215) placed similarly to those of FIG. 1. However, the shape of the walls is modified to avoid the presence of magnetic lines crossing the walls at an angle, which can lead to erosion. Instead, the magnetic lines and walls are parallel in the zone (205). Therefore, FIG. 2 illustrates a magnetically-shielded configuration with lines curving over the surface of the boron nitride walls, to reduce plasma contact and erosion.

Figure 3:
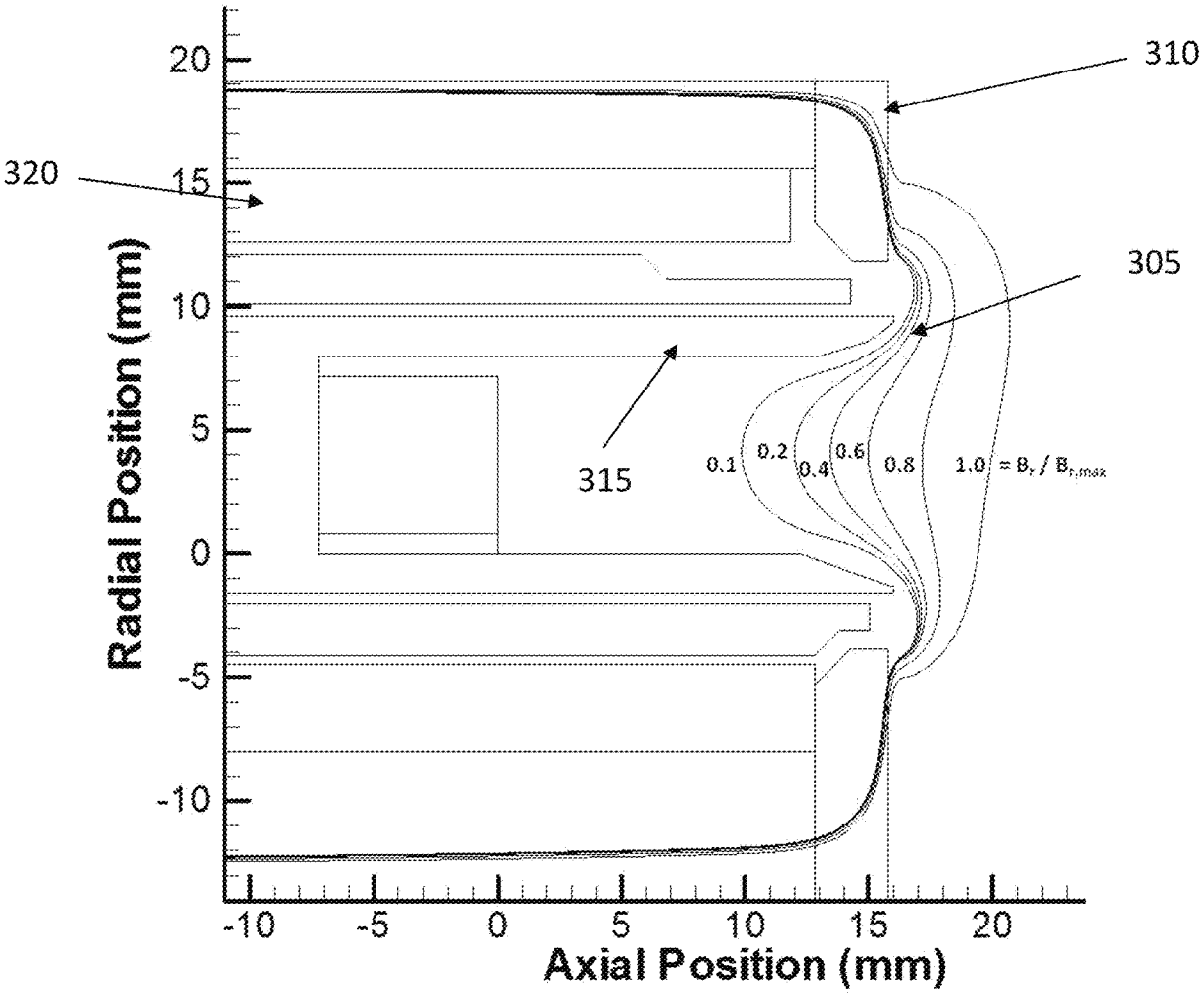
FIG. 3 (Prior Art)
FIG. 3 illustrates magnetic field lines in a miniature magnetically shielded Hall thruster.

FIG. 3 illustrates magnetic field lines in a miniature magnetically shielded Hall thruster. The small size of miniature Hall thrusters makes it extremely difficult to curve the field lines around the discharge chamber wall (305). The poles (310), boron nitride walls (315) and screens (320) are similar to those of FIG. 2.

Figure 4:
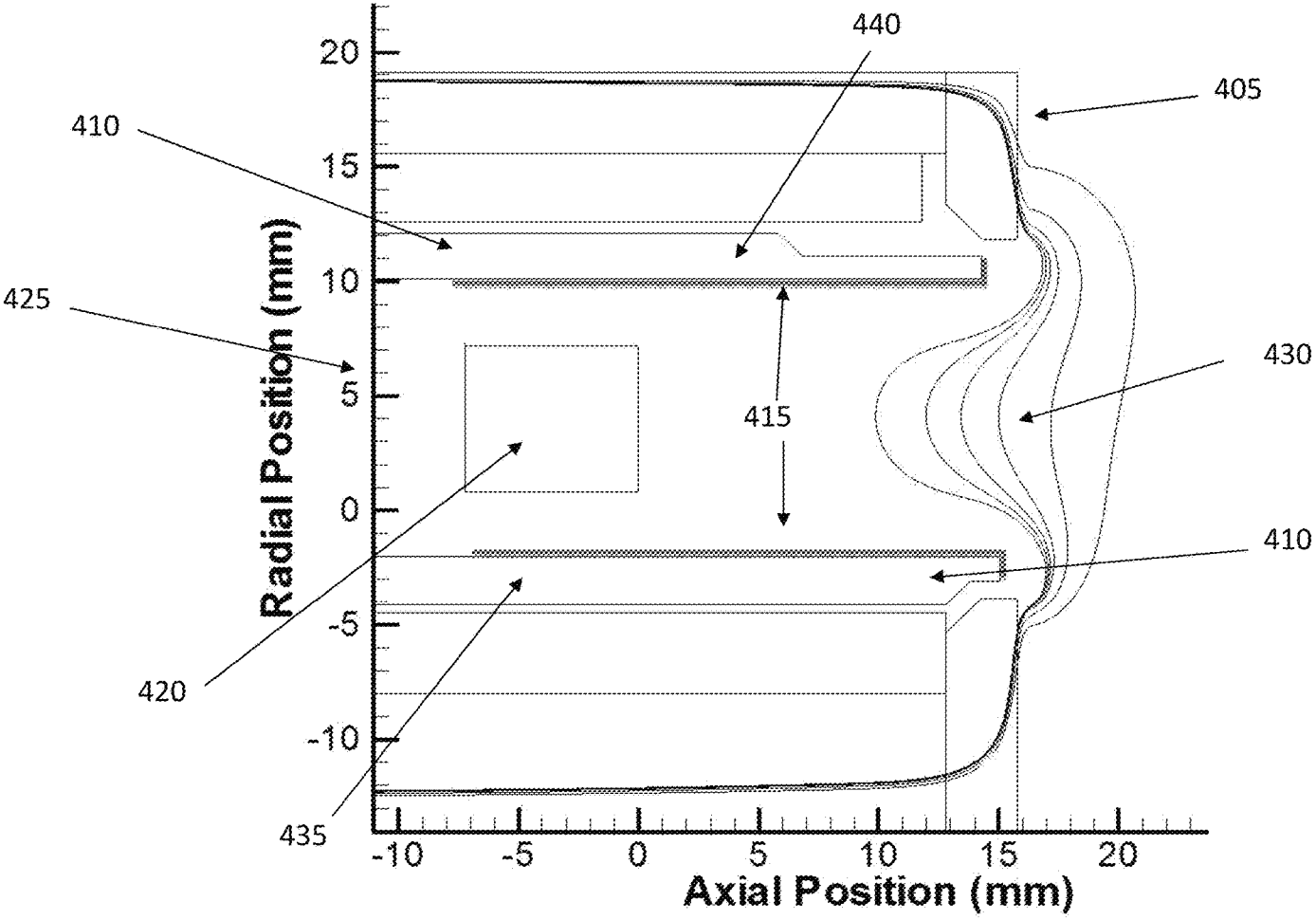
FIG. 4 illustrates a thruster without discharge chamber walls.

FIG. 4 illustrates an embodiment of the thrusters of the present disclosure, specifically a magnetically shielded Hall thruster with the discharge chamber walls removed. The thruster comprises magnetic poles (405) placed in a position similar to that of FIGS. 2 and 3. The screens (410) are also similarly placed. However, the discharge chamber walls are absent. Instead, a coating (415), such as an Al coating, is deposited directly on the screens (410). The chamber also comprises an anode (420), whose support holding it into position is not shown in the figure, for clarity.

As known to the person of ordinary skill in the art, Hall thrusters comprise an annular discharge chamber. Therefore, the cross section of the thruster as illustrated in FIG. 4 is a part of the thruster necessary to illustrate the innovative part. Other parts common to all Hall thrusters are not shown. In particular, the section of FIG. 4 is the top part of the entire thruster cross section, as the person of ordinary skill in the art will understand. An identical bottom section, symmetrical to that illustrated in FIG. 4, will complete the cross section of the thruster. The entire thruster will have a circular discharge chamber. For example, as visible in FIG. 5, an annular discharge chamber (505) spans circularly with a cross section as visible in FIG. 4, along the line (510) of FIG. 5.

Therefore, in some embodiments, the present disclosure describes a Hall thruster comprising an annular discharge chamber having a rear surface with an aperture in the inner wall defined therein, the aperture allowing a gas such as Xenon to be flown through as known in the normal operation of a Hall thruster. The anode and gas distributor will be situated adjacent to the rear surface of the discharge chamber. The gas distributor will inject an ionizable gas in the chamber. A cathode neutralizer can provide electrons, and is normally situated adjacent to the external part of the chamber, which is open to space to allow the flow of propellant gas to exit the discharge chamber. The anode and cathode will be connected to electrical terminals by way of a power supply and a switch, and will generate an axial electrical field within the annular discharge chamber, similarly to conventional Hall thrusters. The magnetic poles will form a magnetic circuit having a magnetic yoke, an inner magnetic coil and an outer magnetic coil, the magnetic circuit configured to be powered by a power supply and provide a substantially radial magnetic field across the annular aperture of the annular discharge chamber. The magnetic circuit is configured to provide a magnetic field that provides magnetic shielding of the discharge chamber. In other words, the magnetic lines will be configured to avoid collisions, and subsequent erosion, of the discharge chamber. Specifically, the present disclosure describes embodiments without walls but with a conductive coating, such as an Al coating, deposited directly on the screens as shown for example in FIG. 4. In these embodiments, the magnetic lines are configured to direct propellant ions away from the conductive coating and the screens. By avoiding these collisions, the need of inner walls in the chamber is avoided, and a subsequent decrease in mass, cost, and complexity can be realized.

The person of ordinary skill in the art will understand that the screens (415) in FIG. 4 can be annular in order to follow the shape of the annular discharge chamber. The screens are disposed between the discharge chamber where the propellant flows, and the magnetic poles.

Figure 5:
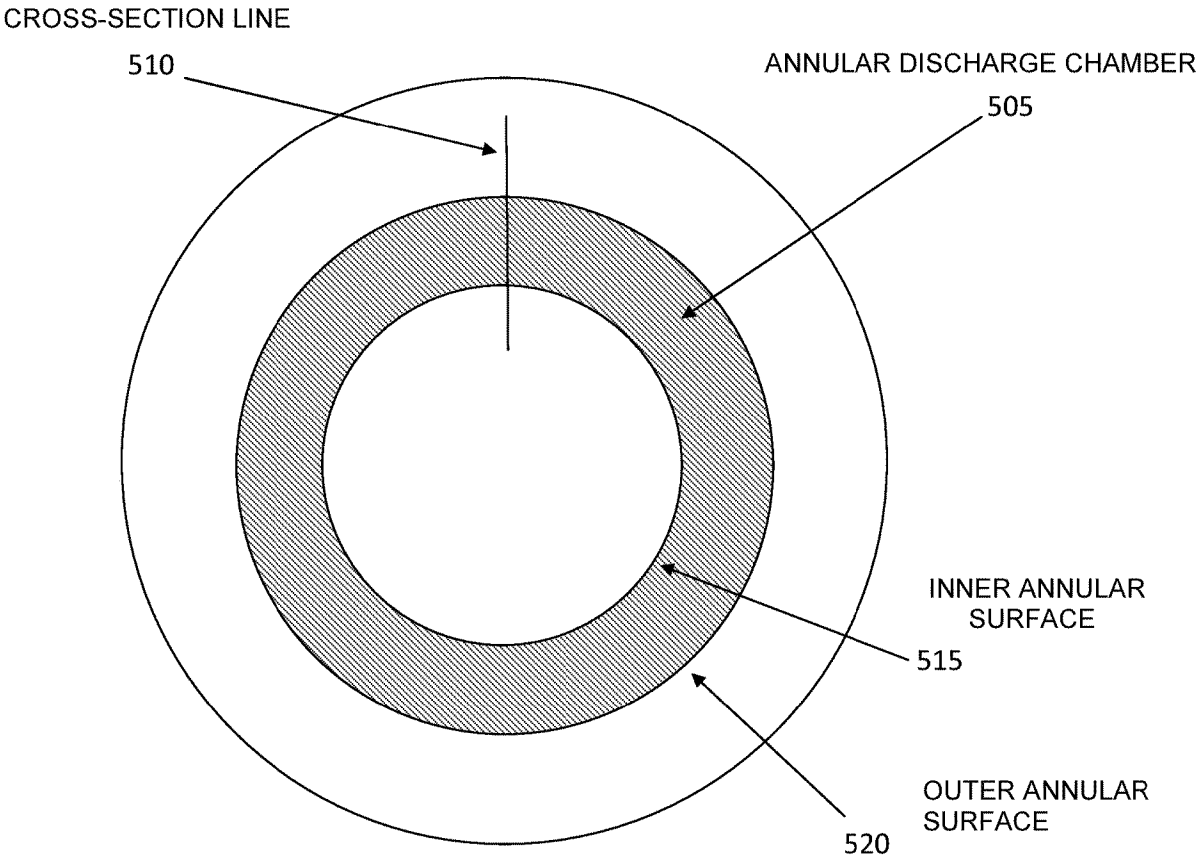
FIG. 5 illustrates an annular discharge chamber.

In some embodiments, the annular chamber can have a rear flat surface, such as (425) in FIG. 4, a front aperture such as (430), an inner annular surface (435) and an outer annular surface (440). In FIG. 5, the inner annular surface (515) and the outer annular surface (520) are also visible. Exemplary ionizable gases comprise xenon, argon and krypton. The gas propellant may also be formed from vapors of elements such as bismuth, iodine, zinc and magnesium.

A number of embodiments of the disclosure have been described. Nevertheless, it will be understood that various modifications may be made without departing from the spirit and scope of the present disclosure. Accordingly, other embodiments are within the scope of the following claims.

The examples set forth above are provided to those of ordinary skill in the art as a complete disclosure and description of how to make and use the embodiments of the disclosure, and are not intended to limit the scope of what the inventor/inventors regard as their disclosure.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A Hall thruster comprising:

an annular discharge chamber having a rear flat surface, a front flat aperture, an inner annular surface and an outer annular surface;

a gas distributor adjacent to the rear flat surface of the annular discharge chamber;

an anode adjacent to the rear flat surface of the annular discharge chamber; a cathode adjacent to the front flat aperture of the annular discharge chamber, the anode and cathode configured to generate an electric field within the annular discharge chamber;

a coating, made of copper, deposited on the inner annular surface and the outer annular surface for thermal dissipation; and magnetic poles configured to generate a magnetic field in the annular discharge chamber, the magnetic field configured to avoid collisions of charged particles against the coating by directing magnetic field lines away from the coating;

wherein no protective walls are present between the coating and the inner annular surface and between the coating and the outer annular surface.

2. The Hall thruster of claim 1, wherein the gas distributor is configured to inject an ionizable gas in the annular discharge chamber.

3. The Hall thruster of claim 2, wherein the ionizable gas is xenon, argon or krypton.

4. The Hall thruster of claim 2, wherein the ionizable gas comprises a vapor of bismuth, iodine, zinc or magnesium.

5. The Hall thruster of claim 1, wherein no boron nitride is present between the coating and the inner annular surface and between the coating and the outer annular surface.

* * * * *